US011050138B2

(12) United States Patent
Huang et al.

(10) Patent No.: US 11,050,138 B2
(45) Date of Patent: Jun. 29, 2021

(54) COMBO SUB 6GHZ AND MMWAVE ANTENNA SYSTEM

(71) Applicant: Futurewei Technologies, Inc., Plano, TX (US)

(72) Inventors: Wei Huang, San Diego, CA (US); Ping Shi, San Diego, CA (US); Xiaoyin He, Plano, TX (US)

(73) Assignee: Futurewei Technologies, Inc., Plano, TX (US)

( * ) Notice: Subject to any disclaimer, the term of this patent is extended or adjusted under 35 U.S.C. 154(b) by 170 days.

(21) Appl. No.: 16/034,240

(22) Filed: Jul. 12, 2018

(65) Prior Publication Data

US 2020/0021009 A1 Jan. 16, 2020

(51) Int. Cl.

| | |
|---|---|
| ***H01Q 1/24*** | (2006.01) |
| ***H01Q 5/378*** | (2015.01) |
| ***H01Q 1/38*** | (2006.01) |
| ***H01Q 21/06*** | (2006.01) |
| ***H01Q 1/22*** | (2006.01) |
| ***H01Q 5/35*** | (2015.01) |
| ***H01Q 5/40*** | (2015.01) |

(52) U.S. Cl.

CPC ..... *H01Q 1/243* (2013.01); *H01Q 1/2291* (2013.01); *H01Q 1/38* (2013.01); *H01Q 5/35* (2015.01); *H01Q 5/378* (2015.01); *H01Q 5/40* (2015.01); *H01Q 21/065* (2013.01)

(58) Field of Classification Search

CPC ..... H01Q 1/243; H01Q 1/2291; H01Q 1/38; H01Q 5/314; H01Q 5/321; H01Q 5/328; H01Q 5/335; H01Q 5/342; H01Q 5/35; H01Q 5/378; H01Q 21/065; H01Q 5/40; H01Q 5/50

See application file for complete search history.

(56) References Cited

U.S. PATENT DOCUMENTS

| | | | |
|---|---|---|---|
| 2010/0164819 | A1 | 7/2010 | Quddus |
| 2014/0306857 | A1 | 10/2014 | Bevelacqua et al. |
| 2015/0044977 | A1 | 2/2015 | Ramasamy et al. |

(Continued)

FOREIGN PATENT DOCUMENTS

| | | | |
|---|---|---|---|
| CN | 103378411 | A | 10/2013 |
| CN | 105811121 | A | 7/2016 |

(Continued)

OTHER PUBLICATIONS

"Qualcomm Announces 5G NR mmWave Prototype to Accelerate Mobile Deployments for Smartphones," Sep. 11, 2017, https://www.qualcomm.com/news/releases/2017/09/11/qualcomm-announces-5g-nr-mmwave-prototype-accelerate-mobile-deployments, 4 pages.

(Continued)

*Primary Examiner* — Robert Karacsony
(74) *Attorney, Agent, or Firm* — Slater Matsil, LLP

(57) ABSTRACT

An embodiment antenna system includes a first antenna portion configured to transmit a first signal received from a first feed and a second antenna portion configured to transmit a second signal received from a second feed. The second antenna portion is capacitively coupled to the second feed and inductively coupled to the first antenna portion, and the second signal has a frequency greater than a frequency of the first signal.

32 Claims, 11 Drawing Sheets

(56) References Cited

U.S. PATENT DOCUMENTS

| | | | | |
|---|---|---|---|---|
| 2015/0091766 | A1* | 4/2015 | Ali | H01Q 5/314 343/750 |
| 2015/0116169 | A1* | 4/2015 | Ying | H01Q 21/08 343/729 |
| 2015/0256207 | A1 | 9/2015 | Liao et al. | |
| 2015/0280318 | A1* | 10/2015 | Yang | H01Q 21/00 343/841 |
| 2019/0260127 | A1* | 8/2019 | Shi | H01Q 9/0421 |

FOREIGN PATENT DOCUMENTS

| | | | |
|---|---|---|---|
| CN | 106848603 | A | 6/2017 |
| CN | 106851743 | A | 6/2017 |

OTHER PUBLICATIONS

Do, Michelle, M., "KT's 5G Strategies: Progresses, System/Device, Service and Key Technologies so far," https://www.netmanias.com/en/post/blog/11024/5g-kt-sdn-nfv/kt-s-5g-strategies-progresses-system-device-service-and-key-technologies-so-far, Dec. 17, 2016, 8 pages.

Hong, Wonbin et al., "Study and Prototyping of Practically Large-Scale mmWave Antenna Systems for 5G Cellular Devices," Millimeter-Wave Communications for 5G, IEEE Communications Magazine, Sep. 2014, pp. 63-69.

Vyas, Kishan, "Qualcomm Successfully Trials 5G Data Connection on Its Snapdragon X50 Modem," https://www.kda-developers.com/qualcomm-5g-snapdragon-x50-modem/, Oct. 17, 2017, 2 pages.

* cited by examiner

COMBO SUB 6GHZ AND MMWAVE ANTENNA SYSTEM

TECHNICAL FIELD

The present disclosure relates generally to an antenna system and, in particular embodiments, to an antenna system that is a combination of a sub six gigahertz antenna and a millimeter wave antenna.

BACKGROUND

A user equipment (UE) or any other device used by an end user to communicate will be referred to herein as a UE. A UE might contain multiple antennas operating in multiple different frequency bands. For example, a UE might include an antenna for a second generation (2G) band, an antenna for a third generation (3G) band, an antenna for a fourth generation (4G) Long Term Evolution (LTE) band, an antenna for a Global Positioning System (GPS) unit, and/or an antenna for a Wi-Fi system. In addition, fifth generation (5G) UEs might include one or more sub 6 gigahertz (GHz) antennas and/or one or more millimeter wave (mmWave) antennas.

The term "sub 6 GHz" is typically used by those of skill in the art to refer to signals that have traditionally been used in cellular communications, and the term will be used in that manner herein. The frequency range for such signals might be between approximately 30 megahertz (MHz) and approximately 6 GHz, but the frequency range is not necessarily limited to those lower and upper values.

The term "mmWave" is typically used by those of skill in the art to refer to signals with a frequency in a range of approximately 24 GHz to 300 GHz, and the term will be used in that manner herein. However, the frequency range is not necessarily limited to those lower and upper values.

SUMMARY

In accordance with an embodiment of the present disclosure, an antenna system comprises a first antenna portion configured to transmit a first signal received from a first feed and a second antenna portion configured to transmit a second signal received from a second feed. The second antenna portion is capacitively coupled to the second feed and inductively coupled to the first antenna portion, and the second signal has a frequency greater than a frequency of the first signal.

In the previous embodiment, the second antenna portion might be capacitively coupled to the second feed via a capacitive coupling structure that includes a discrete or distributed capacitor. In any of the previous embodiments, the capacitive coupling structure might be at least one of parallel conductive plates in one plane; parallel conductive plates on different planes; or interdigitally coupled lines. In any of the previous embodiments, the second antenna portion might be inductively coupled to the first antenna portion via an inductive coupling structure that includes a discrete or distributed inductor. In any of the previous embodiments, the inductive coupling structure might be at least one of a wire-wound discrete inductor or a distributed transmission line on a substrate. In any of the previous embodiments, the first signal might have a frequency in a range of 30 MHz to 6 GHz. In any of the previous embodiments, the second signal might have a frequency in a range of 24 GHz to 300 GHz. In any of the previous embodiments, the frequency of the second signal might be at least ten times greater than the frequency of the first signal. In any of the previous embodiments, the antenna system might further comprise a third antenna portion inductively coupled to the second antenna portion and configured to transmit the first signal, the first signal having been received by the third antenna portion via the first antenna portion and the second antenna portion. In any of the previous embodiments, inductive coupling between the first antenna portion and the second antenna portion and between the second antenna portion and the third antenna portion might create impedance that limits passage of the second signal between the first, second, and third antenna portions more than passage of the first signal between the first, second, and third antenna portions. In any of the previous embodiments, the second antenna portion might be disposed within a frame of a device that includes the antenna system. In any of the previous embodiments, the first antenna portion might be at least one of disposed within a frame of a device that includes the antenna system or disposed on a circuit board within a device that includes the antenna system. In any of the previous embodiments, the second antenna portion might be at least one of disposed within a frame of a device that includes the antenna system or disposed on a circuit board within a device that includes the antenna system.

In accordance with another embodiment of the present disclosure, a method for transmitting or receiving from an antenna system is provided. The method comprises transmitting or receiving, from or to a first antenna portion of the antenna system, a first signal received from or to a first feed with a frequency in a range of 30 MHz to 6 GHz, and transmitting or receiving, from or to a second antenna portion of the antenna system, a second signal received from or to a second feed with a frequency in a range of 24 GHz to 300 GHz. The second antenna portion is capacitively coupled to the second feed and inductively coupled to the first antenna portion.

In the previous embodiment, the second antenna portion might be capacitively coupled to the second feed via a capacitive coupling structure that includes a discrete or distributed capacitor. In any of the previous embodiments, the capacitive coupling structure might be at least one of parallel conductive plates in one plane; parallel conductive plates on different planes; or interdigitally coupled lines. In any of the previous embodiments, the second antenna portion might be inductively coupled to the first antenna portion via an inductive coupling structure that includes a discrete or distributed inductor. In any of the previous embodiments, the inductive coupling structure might be at least one of a wire-wound discrete inductor or a distributed transmission line on a substrate. In any of the previous embodiments, the second signal might be transmitted or received at a frequency at least ten times greater than a frequency of the first signal. In any of the previous embodiments, the method might further comprise transmitting the first signal from a third antenna portion of the antenna system. The third antenna portion might be inductively coupled to the second antenna portion, and the first signal might have been received by the third antenna portion via the first antenna portion and the second antenna portion. In any of the previous embodiments, inductive coupling between the first antenna portion and the second antenna portion and between the second antenna portion and the third antenna portion might create impedance that limits passage of the second signal between the first, second, and third antenna portions more than passage of the first signal between the first, second, and third antenna portions. In any of the previous embodiments, the first antenna portion might be at least one of disposed within a frame of a device that includes the antenna system or formed on a circuit board within a device that includes the antenna system. In any of the previous embodiments, the second antenna portion might be at least one of disposed within a frame of a device that includes the antenna system or formed on a circuit board within a device that includes the antenna system.

In accordance with another embodiment of the present disclosure, an antenna system comprises a first antenna portion configured to transmit a first signal received from a first feed; a second antenna portion configured to transmit a second signal received from a second feed, the second antenna portion capacitively coupled to the second feed and inductively coupled to the first antenna portion, and the second signal having a frequency greater than a frequency of the first signal; and a third antenna portion inductively coupled to the second antenna portion and configured to transmit the first signal, the first signal having been received by the third portion via the first antenna portion and the second antenna portion.

In the previous embodiment, the second antenna portion might be capacitively coupled to the second feed via a capacitive coupling structure that includes a discrete or distributed capacitor. In any of the previous embodiments, the capacitive coupling structure might be at least one of parallel conductive plates in one plane; parallel conductive plates on different planes; or interdigitally coupled lines. In any of the previous embodiments, the second antenna portion might be inductively coupled to the first antenna portion via a first inductive coupling structure that includes at least one discrete or distributed inductor, and the second antenna portion might be inductively coupled to the third antenna portion via a second inductive coupling structure that includes at least one discrete or distributed inductor. In any of the previous embodiments, at least one of the first inductive coupling structure or the second inductive coupling structure might be at least one of a wire-wound discrete inductor or a distributed transmission line on a substrate. In any of the previous embodiments, the first signal might be a sub 6 gigahertz signal. In any of the previous embodiments, the second signal might be a millimeter wave signal. In any of the previous embodiments, the frequency of the second signal might be at least ten times greater than the frequency of the first signal. In any of the previous embodiments, inductive coupling between the first antenna portion and the second antenna portion and between the second antenna portion and the third antenna portion might create impedance that limits passage of the second signal between the first, second, and third antenna portions more than passage of the first signal between the first, second, and third antenna portions. In any of the previous embodiments, the first antenna portion might be at least one of disposed within a frame of a device that includes the antenna system or disposed on a circuit board within a device that includes the antenna system. In any of the previous embodiments, the second antenna portion might be at least one of disposed within a frame of a device that includes the antenna system or disposed on a circuit board within a device that includes the antenna system.

An advantage of the embodiments is that a combination of a sub 6 GHz antenna and a mmWave antenna takes up substantially the same amount of space as the sub 6 GHz antenna alone.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION OF ILLUSTRATIVE EMBODIMENTS

The structure, manufacture and use of the presently preferred embodiments are discussed in detail below. It should be appreciated, however, that the present disclosure provides many applicable novel concepts that can be embodied in a wide variety of specific contexts. The specific embodiments discussed are merely illustrative of specific ways to make and use the embodiments, and do not limit the scope of the disclosure.

As the number of antennas included in UEs increases, the difficulty in fitting all the antennas in the limited space of a UE also increases. Embodiments disclosed herein provide an antenna system that combines a sub 6 GHz antenna and a mmWave antenna and that efficiently uses the limited space within a UE. For simplicity, the various embodiments of a combined sub 6 GHz antenna and mmWave antenna will be referred to hereinafter as the combination antenna system.

The embodiment combination antenna systems might be described herein as being installed in a UE, but it should be understood that the combination antenna systems could be installed in other types of devices. Also, the embodiment combination antenna systems might be described herein in terms of example shapes and sizes, but it should be understood that the antenna systems could have other shapes and sizes. In addition, signals might be described herein as being transmitted by a UE, but similar concepts might apply to signals received by a UE.

To achieve a high gain, mmWave antennas might be deployed in arrays of different dimensions. For example, mmWave antennas might be arranged in a 1×2 array, a 2×2 array, a 2×4 array, or an array with other dimensions. In addition, mmWave antennas might be implemented in a packaged array or other self-contained module that might have connector pins for connection to a printed circuit board (PCB). Alternatively, mmWave antennas might be printed or otherwise formed directly on either a rigid PCB or a PCB with a flexible, bendable substrate. Any such mmWave antenna configuration or combination of configurations might be appropriate for the embodiment combination antenna systems disclosed herein.

Figure 1:
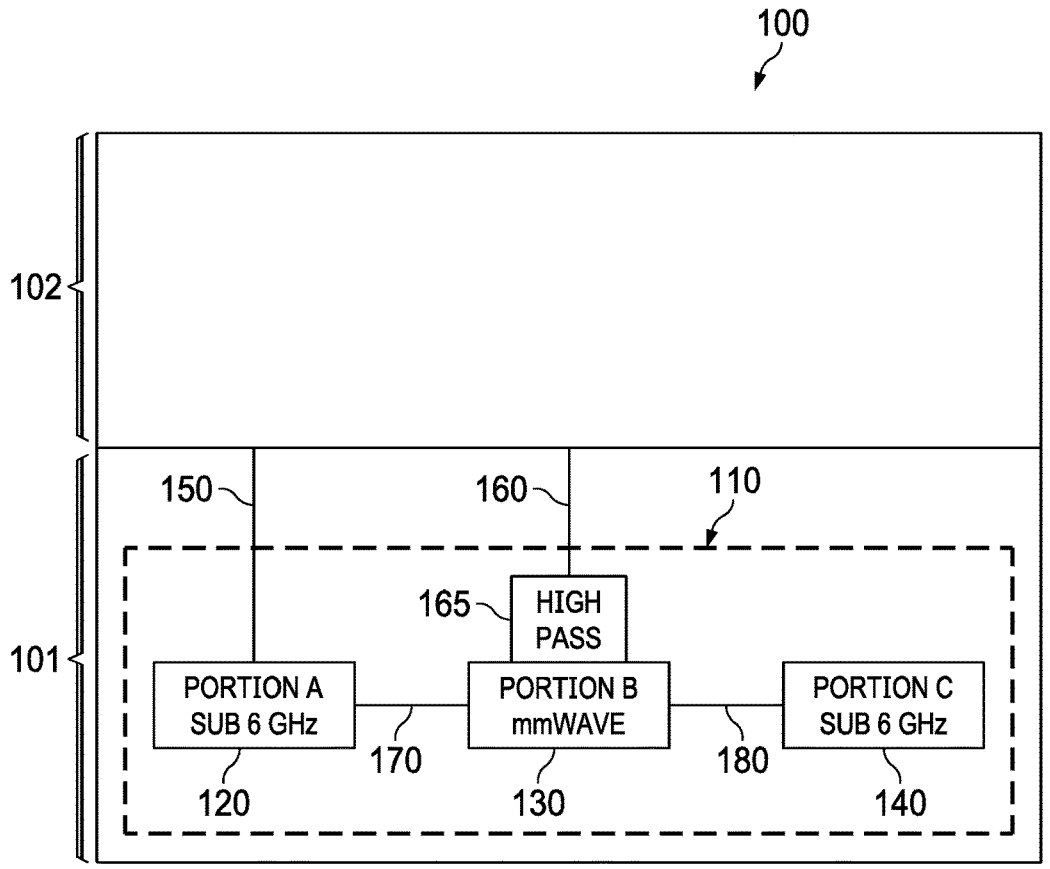
FIG. 1 is a diagram illustrating an embodiment combination sub 6 GHz antenna and mmWave antenna system.

FIG. 1 illustrates a UE 100 that includes an idealized depiction of an embodiment combination antenna system 110. The UE 100 may be viewed as having been cut open to reveal the combination antenna system 110 within a first section 100 of the UE 100. Other components in the UE 100 might be contained in a second section 102 of the UE 100.

The combination antenna system 110 and other combination antenna systems might be described herein as having a sub 6 GHz antenna portion A 120, a mmWave antenna portion B 130, and another sub 6 GHz antenna portion C 140, where portion C 140 is optional, depending on the specific design. That is, portion A 120 is a first section of a sub 6 GHz antenna, portion B 130 is a mmWave antenna, and portion C 140 is a second section of the sub 6 GHz antenna. In other embodiments, other numbers and arrangements of the portions might be used. For example, portion C 140 might not present, and only the sub 6 GHz antenna portion A 120 and the mmWave antenna portion B 130 might be present. In other embodiments, portion B 130 might be a phased array antenna or might comprise multiple mmWave antennas. In other embodiments, the combination antenna system 110 might be represented as A/B/B/B/B/C or a similar pattern of portions. In other words, a single portion A 120 might be present, multiple instances of portion B 130 might be present, and a single portion C 140 might be present. As another example, multiple sub 6 GHz antennas and multiple mmWave antennas might be present in an A/B/C/D/E, etc., pattern, where B and D are mmWave antennas or antenna arrays and are separated by sub 6 GHz antenna portions. Although the portions are depicted as separate components, the portions might be components within a single antenna structure.

In an embodiment, portion A 120 is inductively coupled to portion B 130, and portion B 130 is inductively coupled to portion C 140, where inductively coupled means two conductors are physically and electrically connected to one another through either a discrete or a distributed inductor. Examples of inductively coupled structures include a wire-wound discrete inductor or a distributed transmission line such as a 0.254 mm wide, 2.54 mm long stripline on top of a 1.25 mm thick substrate, where the distributed transmission line has about a 10 nanohenry inductance. In another embodiment, the coupling between the sub 6 GHz portion A 120 and the mmWave antenna portion B 130 is a band pass connection with a pass of a desired sub 6 GHz band or a band stop connection with a stop band at the intended mmWave band. Because of the inductive coupling between portion A 120 and portion B 130 and between portion B 130 and portion C 140, the connections between each of the portions have a relatively high impedance at relatively high frequencies and a relatively low impedance at relatively low frequencies. Any physical and electrical connection between components that provides a relatively high impedance between the components at relatively high frequencies and provides a relatively low impedance between the components at relatively low frequencies will be referred to herein as an impedance line. An impedance line might be any combination of electrical conductors and coils, or the microelectronic equivalent of coils, that, through inductive coupling, provides a desired impedance characteristic. For example, an impedance line might be a piece of straight or curved transmission line, or might be a single layer structure or multiple layers connected through vias.

In an embodiment, impedance line 170 physically and electrically connects portion A 120 to portion B 130, and impedance line 180 physically and electrically connects portion B 130 to portion C 140. Although the impedance lines 170 and 180 and other impedance lines shown in other drawings described herein might be depicted as single lines, it should be understood that the impedance lines 170 and 180 and other impedance lines might include various combinations of electrical conductors and coils or the microelectronic equivalent of coils. The impedance lines 170 and 180 (modeled as inductors) might allow an electrical connection at some frequencies but might substantially block an electrical connection at other frequencies. That is, because impedance is directly proportional to frequency, the sub 6 GHz signal and the mmWave signal experience different impedances when passing through the impedance lines 170 and 180. The relatively higher frequency mmWave signal experiences a relatively high impedance at the impedance lines 170 and 180 and is thus effectively blocked from reaching and radiating from portion A 120 or portion C 140. The mmWave signal fed in at the second feed 160 thus effectively radiates only from portion B 130.

The relatively lower frequency sub 6 GHz signal, on the other hand, experiences a relatively low impedance at the impedance lines 170 and 180. Thus, the sub 6 GHz signal fed in at the first feed 150 can radiate from portion A 120, pass through impedance line 170 to reach portion B 130, radiate from portion B 130, pass through impedance line 180 to reach portion C 140, and radiate from portion C 140.

In other words, the impedance lines 170 and 180 that physically and electrically connect the mmWave antenna portion B 130 to the sub 6 GHz antenna portions A 120 and C 140 can be viewed as low pass or band pass connections. As is well known in the art, a low pass connection typically includes electrical components arranged in a circuit such that signals with a frequency lower than a cutoff frequency pass through the connection, and signals with a frequency higher than the cutoff frequency do not pass through the connection. Due to the low pass connections, a sub 6 GHz radio frequency (RF) signal can pass between the mmWave antenna portion B 130 and the sub 6 GHz antenna portions A 120 and C 140, but a mmWave signal cannot pass between the mmWave antenna portion B 130 and the sub 6 GHz antenna portions A 120 and C 140.

When reference is made herein to a signal passing through a connection or between connections, it should be understood that a negligible amount of attenuation of the signal might occur, and when reference is made herein to a signal not passing through a connection or between connections, it should be understood that the signal might be attenuated to down a negligible level. In other words, even with the high impedance experienced by the mmWave signal, at least some portion of the mmWave signal might pass from portion B 130 to portion A 120 and portion C 140. It may be stated more generally that the mmWave signal is attenuated more from passing between portion A 120, portion B 130, and portion C 140 than the sub 6 GHz signal is attenuated from passing between portion A 120, portion B 130, and portion C 140. That is, the inductive coupling of the impedance lines 170 and 180 almost entirely blocks the mmWave signal but causes little or no resistance for the passage of the sub 6 GHz signal.

In an embodiment, the combination antenna system 110 is fed by two separate feeds, one for sub 6 GHz signals and one for mmWave signals. That is, a first feed 150 feeds a sub 6 GHz signal into the sub 6 GHz antenna in portion A 120, and a second feed 160 feeds a mmWave signal into the mmWave antenna in portion B 130. To reduce the coupling between the sub 6 GHz system and the mmWave system, the mmWave antenna 130 is physically and electrically connected to the mmWave antenna feed 160 through a high pass connection 165 or a band pass matching circuit. As is well known in the art, a high pass connection typically includes electrical components arranged in a circuit such that signals with a frequency higher than a cutoff frequency pass through the connection, and signals with a frequency lower than the cutoff frequency do not pass through the connection. Due to the high pass connection 165, a mmWave signal can pass from the mmWave antenna feed 160 to the mmWave antenna 130, but a sub 6 GHz RF signal will be attenuated down to a negligible level at the mmWave antenna feed 160. In other words, the second feed 160 is capacitively coupled (high pass) to the mmWave antenna in portion B 130, where capacitively coupled means two conductors are physically and electrically connected to one another through either a discrete or a distributed capacitor. Examples of capacitively coupled structures include parallel conductive plates in one plane, parallel conductive plates on different planes that might or might not overlap, or interdigitally coupled lines that might be arranged in a pattern such as a square wave. Because of the capacitive coupling between the mmWave antenna feed 160 and the mmWave antenna 130, the second feed 160 has a relatively low impedance at the relatively high mmWave frequencies and a relatively high impedance at the relatively low sub 6 GHz frequencies. The second feed 160 is therefore effectively an open circuit with respect to the sub 6 GHz antennas in portion A 120 and portion C 140. The mmWave antenna in portion B 130 can thus be placed anywhere within an antenna structure that includes a sub 6 GHz antenna. The capacitive coupling between the mmWave antenna feed 160 and the mmWave antenna 130 is independent of the locations of the mmWave antenna feed 160 and the mmWave antenna 130. In another embodiment, the high pass connection 165 between the second feed 160 and the mmWave antenna portion B 130 is a serial inductance/capacitance (LC) resonator (band pass), with a pass band in the targeted mmWave band. One of skill in the art will be aware of values of inductance and capacitance that might be appropriate for such a high pass connection 165, and the embodiments disclosed herein are not limited to any specific values of inductance or capacitance in the high pass connection 165.

As mentioned above, the sub 6 GHz antenna in portion A 120 and portion C 140 might transmit signals with frequencies in the range of approximately 30 MHz to approximately 6 GHz, and the mmWave antenna in portion B 130 might transmit signals with frequencies in the range of approximately 24 GHz to approximately 300 GHz. In an embodiment, where inductive impedance lines are used to couple signals between portion A 120 and portion B 130 and between portion B 130 and portion C 140, the mmWave antenna transmits at a frequency at least ten times greater than the frequency at which the sub 6 GHz antenna transmits. Therefore, the impedance lines 170 and 180 have an impedance at least ten times greater for the mmWave antenna than for the sub 6 GHz antenna. In another embodiment, where another band pass or band stop coupling structure is used, the ratio of the mmWave signal frequency to the sub 6 GHz RF signal frequency may be less than ten while keeping enough isolation between the mmWave antenna portion B 130 and the sub 6 GHz antenna portion A 120. The actual acceptable ratio of mmWave signal frequency to sub 6 GHz RF signal frequency depends on the frequency response of the coupling structure.

With the physical and electrical arrangement of components described above, the mmWave signal fed into portion B 130 can radiate substantially independently from the sub 6 GHz signal fed into portion A 120, even though portion A 120 and portion B 130 share the same physical antenna structure of the combination antenna system 110. In other words, the mmWave signal fed into portion B 130 might radiate almost entirely from portion B 130, with little to no mmWave signal radiation from portion A 120 or portion C 140. The sub 6 GHz signal fed into portion A 120, on the other hand, might radiate from portion A 120, from portion B 130, and from portion C 140, with little signal coupled into the mmWave antenna feed 160 (thus to the mmWave subsystem). Stated another way, the radiating parts of the combination antenna system 110 might be considered continuous at sub 6 GHz frequencies, but portion B 130 might be considered a discrete component at mmWave frequencies.

When the combination antenna system 110 is created by combining a mmWave antenna and a sub 6 GHz antenna in the configuration described herein, the design of the sub 6 GHz antenna does not need to be substantially changed, and the resulting combination antenna system 110 does not take up substantially more space than the sub 6 GHz antenna alone. Furthermore, the performance of the sub 6 GHz antenna and the performance of the mmWave antenna are not significantly hampered, despite the two antennas residing in the same physical antenna structure.

Figure 2:
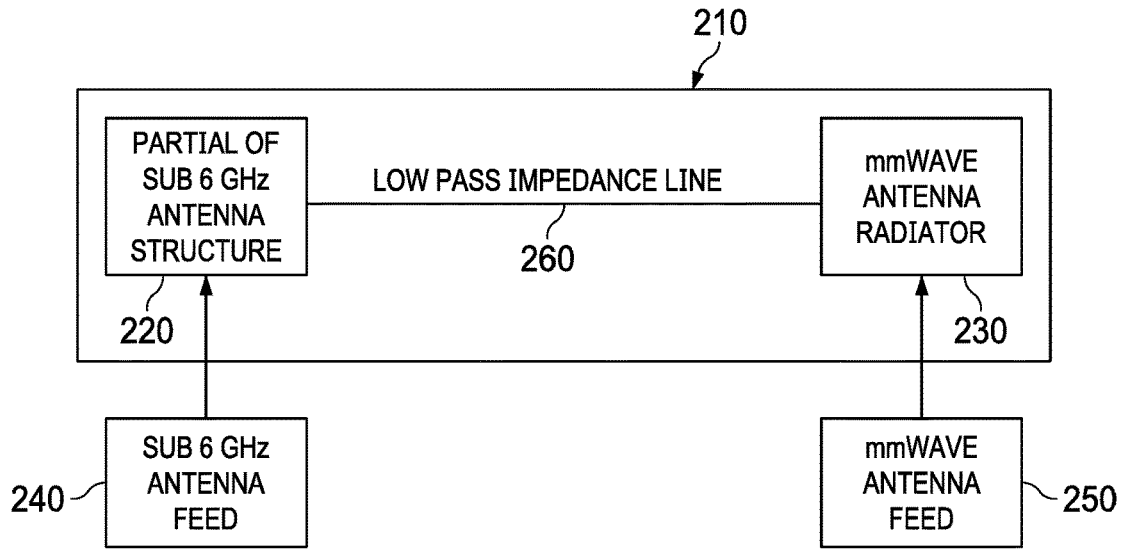
FIG. 2 is a diagram illustrating another embodiment combination sub 6 GHz antenna and mmWave antenna system.

FIG. 2 illustrates another idealized depiction of an embodiment combination antenna system 210. The combination antenna system 210 might be substantially similar to the combination antenna system 110 of FIG. 1. The combination antenna system 210 includes a partial sub 6 GHz antenna structure 220 that might be substantially similar to portion A 120 of FIG. 1. The combination antenna system 210 further includes one or more mmWave antenna radiators 230 that might be substantially similar to portion B 130 of FIG. 1. As used herein, the term "radiator" might refer to any component capable of radiating an electromagnetic wave. The partial sub 6 GHz antenna structure 220 is fed by a sub 6 GHz antenna feed 240, and the mmWave antenna radiators 230 are independently fed by mmWave antenna feeds 250.

A low pass (or band pass/band stop) impedance line 260 physically and electrically connects the partial sub 6 GHz antenna structure 220 and the mmWave antenna radiators 230 and might be substantially similar to the impedance lines 170 and 180 of FIG. 1. The impedance line 260 has a relatively high impedance at relatively high frequencies and has a relatively low impedance at relatively low frequencies. Thus, the relatively low frequency signals from the sub 6 GHz antenna feed 240 can pass through the impedance line 260 to the mmWave antenna radiators 230, but the relatively high frequency signals from the mmWave antenna feed 250 cannot pass through the impedance line 260 to the partial sub 6 GHz antenna structure 220. Therefore, the mmWave antenna radiators 230 are effectively an open circuit with respect to the partial sub 6 GHz antenna structure 220. The mmWave antenna radiators 230 and the mmWave antenna feed 250 are physically and electrically connected though a high pass (or band pass) connection, which effectively has high impedance at a sub 6 GHz band and effectively has low impedance at a mmWave band. Thus, the sub 6 GHz antenna feed 240 and the mmWave antenna feed 250 can function substantially independently from one another, even though the partial sub 6 GHz antenna structure 220 and the mmWave antenna radiators 230 are components in the same combination antenna system 210.

The embodiment combination antenna system 200 of FIG. 2 might be contrasted with a prior art dual-feed, dual-band antenna. In such an antenna, an RF dual-band signal is typically fed into a diplexer. Filters in the diplexer separate the RF dual-band signal into a low band feed and a high band feed. The low band feed and the high band feed are then radiated together from a shared antenna radiator. That is, both the low band feed and the high band feed are radiated from substantially all portions of the shared antenna radiator.

Figure 3A:
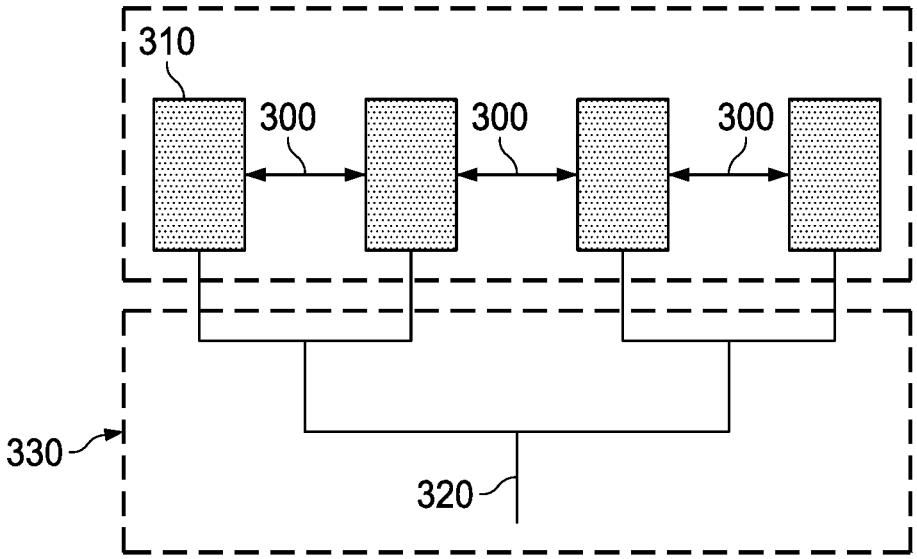
FIG. 3A is a diagram illustrating an embodiment mmWave antenna radiator.
Figure 3B:
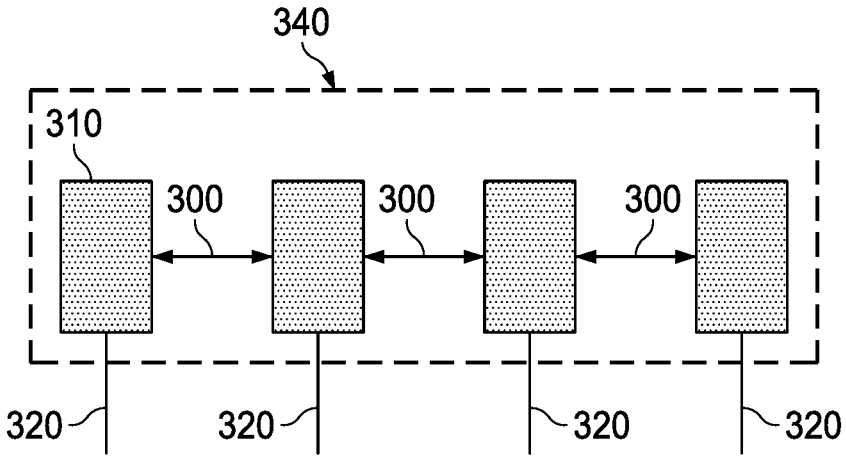
FIG. 3B is a diagram illustrating another embodiment mmWave antenna radiator.

FIGS. 3A and 3B demonstrate possible embodiments of mmWave antenna radiators 310 and mmWave antenna feeds 320. mmWave antenna radiators 310 and mmWave antenna feeds 320 might be similar to radiator 230 and feed 250, respectively, in FIG. 2 or portion B 130 and feed 160, respectively, in FIG. 1. In FIG. 3A, multiple mmWave element antennas 310 are fed through a power distribution network 330, which is frequency selective, high pass or band pass, to pass through a mmWave signal and reject a sub 6 GHz RF signal. The power distribution network 330 might be an RF power distribution network. The mmWave signals from the feed 320 might be split into two signals by a power splitter and then split into four signals by cascaded power splitters. Thus, mmWave power is distributed into four element antennas 310 as in the FIG. 3A. On the receiving side, the mmWave signals collected through the element antennas 310 might be combined through the splitters (combiners) and summed at the antenna feed. The power distribution network 330 can be used to control how much power is distributed to each element antenna 310. By varying the path delay between the feed 320 and the element antenna feeds, the power distribution network 330 can control the relative signal phase between each element antenna 310, thus steering a fixed beam in a certain direction. The power distribution network 330 by nature is frequency dependent. Distribution network 330 with feed 320 might be equivalent to feed 250 in FIG. 2 or feed 160 in FIG. 1. A single feed 320 is used to feed the antenna, and the antenna is treated as a single antenna. Between each element antenna 310, a low pass (or band pass) connection 300 is used, which has high impedance at the mmWave band and low impedance at the sub 6 GHz band. The connections 300 might be substantially similar to the impedance lines 170 and 180 of FIG. 1 and the impedance line 260 of FIG. 2. Multiple element antenna 310 with connections 300 is equivalent to the mmWave antenna radiator 230 in FIG. 2 or portion B 130 in FIG. 1.

In FIG. 3B, multiple individually fed antennas 310 are present. Each element antenna 310 is coupled to an adjacent element antenna 310 though a low pass (or band pass) connection 300. Multiple element antenna 310 with connection 300, marked as 340, is equivalent to the mmWave antenna radiator 230 in FIG. 2 or portion B 130 in FIG. 1. The multiple feeds 320 are equivalent to feed 250 in FIG. 2 or feed 160 in FIG. 1. In an embodiment, the connection 300 is realized with an inductive impedance line, which has impedance proportional to frequency. In an embodiment, a high pass connection (not shown) between feed 320 and antenna 310 or between power distribution network 330 and antenna 310 is realized by a capacitive coupling structure, which has impedance inversely proportional to frequency. The high pass connection (not shown) between feed 320 and antenna 310 or between power distribution network 330 and antenna 310 might be substantially similar to the high pass structure 165 of FIG. 1.

Figure 4:
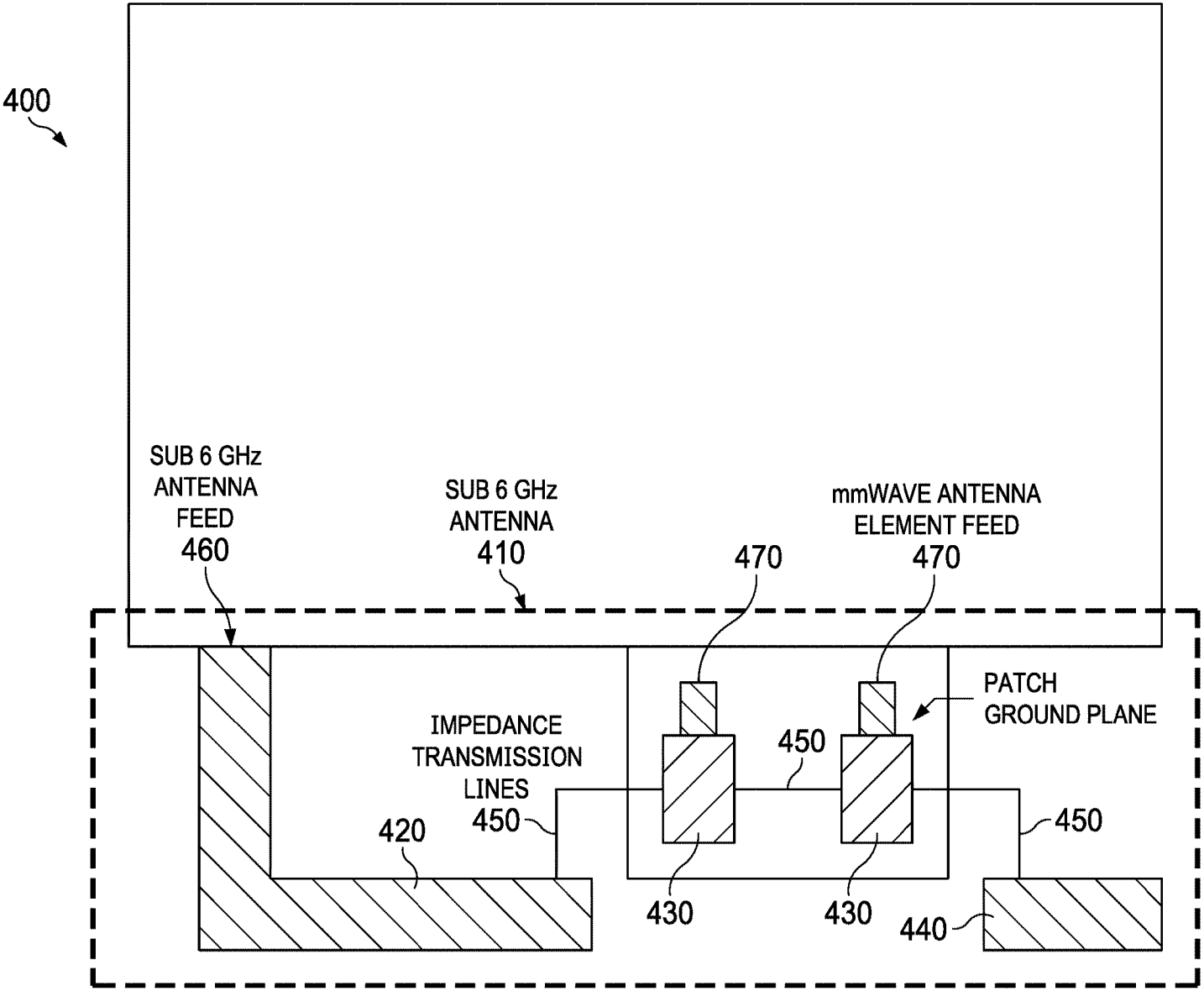
FIG. 4 is a diagram illustrating another embodiment combination sub 6 GHz antenna and mmWave antenna system.

FIG. 4 illustrates a UE 400 that includes an embodiment combination antenna system shown in more detail. A sub 6 GHz antenna 410 includes a first sub 6 GHz antenna portion 420 that might be substantially similar to portion A 120 of FIG. 1. The sub 6 GHz antenna 410 also includes a mmWave antenna array 430 that might be substantially similar to portion B 130 of FIG. 1 or structure 340 of FIG. 3B. In this example, two mmWave antennas are present in the mmWave antenna array 430, but in other embodiments, other numbers of mmWave antennas might be present in the mmWave antenna array 430. Also, the mmWave antenna array 430 might have other arrangements, such as a square grid, a triangular grid, or a hexagonal grid, and all antenna elements or a portion of the antenna elements might be present in an array. In an embodiment, the mmWave antenna array 430 is a patch antenna. In another embodiment, the mmWave antenna array 430 is a monopole antenna. The two mmWave antennas in the mmWave antenna array 430 are coupled to each other through an impedance line 450, which has impedance proportional to frequency. The sub 6 GHz antenna 410 further includes a second sub 6 GHz antenna portion 440 that might be substantially similar to portion C 140 of FIG. 1. The first sub 6 GHz antenna portion 420 is connected to the mmWave antenna array 430 and the mmWave antenna array 430 is connected to the second sub 6 GHz antenna portion 440 by impedance lines 450 that might be substantially similar to the impedance lines 170 and 180 of FIG. 1. The first sub 6 GHz antenna portion 420 is fed by a sub 6 GHz antenna feed 460 that might be substantially similar to the first feed 150 of FIG. 1. The mmWave antenna array 430 is fed by a mmWave antenna element feed 470 that might be substantially similar to the second feed 160 of FIG. 1 or feeds 320 in FIG. 3B.

The combination of the first sub 6 GHz antenna portion 420, the mmWave antenna array 430, the second sub 6 GHz antenna portion 440, and the impedance lines 450 might be viewed as being substantially similar to the combination antenna system 110 of FIG. 1. Alternatively, the mmWave antenna array 430 might be viewed as residing within the sub 6 GHz antenna 410 and as connected to the first sub 6 GHz antenna portion 420 of the sub 6 GHz antenna 410 and the second sub 6 GHz antenna portion 440 of the sub 6 GHz antenna 410 by the impedance lines 450.

Figure 5:
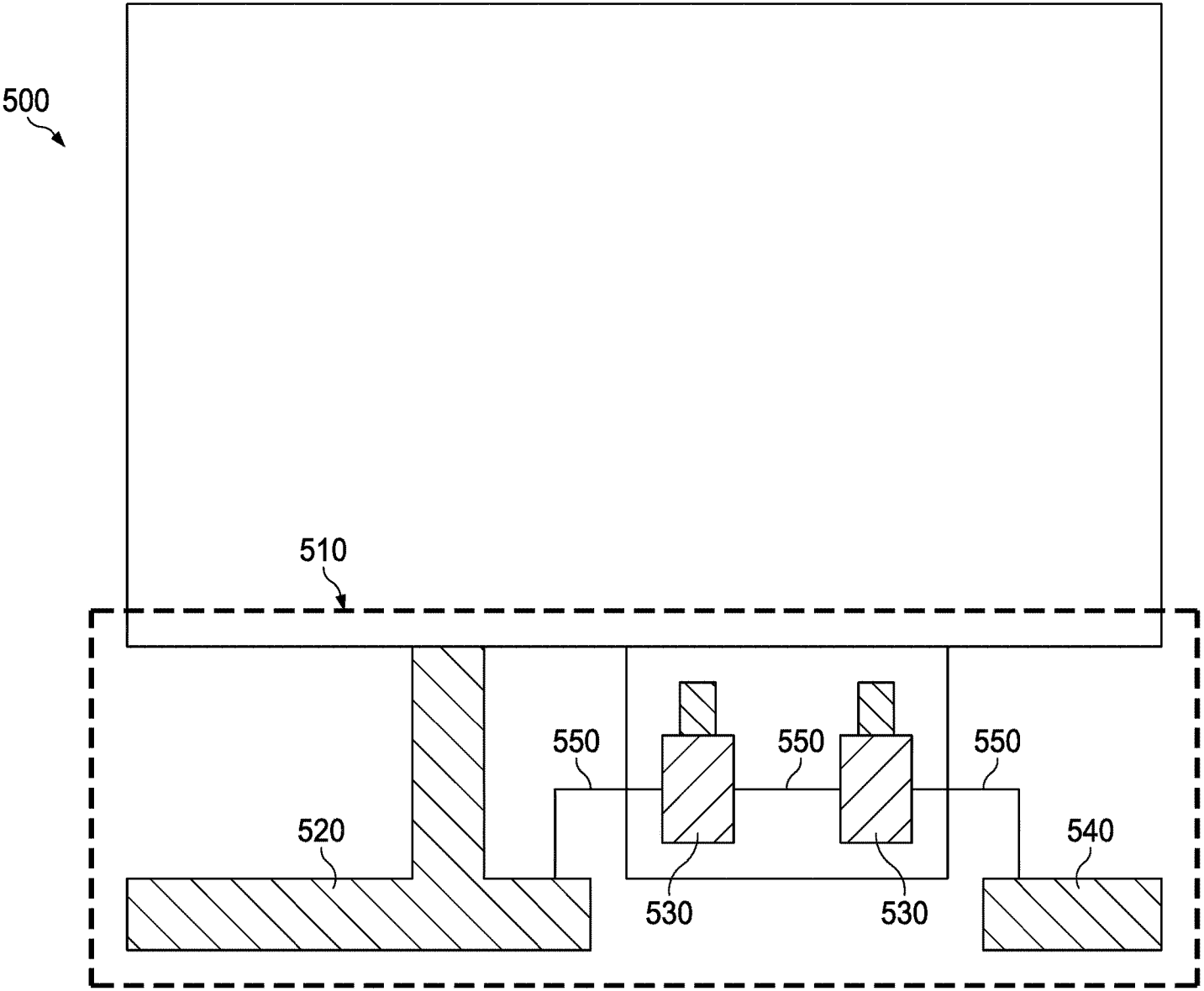
FIG. 5 is a diagram illustrating another embodiment combination sub 6 GHz antenna and mmWave antenna system.

FIG. 5 illustrates a UE 500 that includes an embodiment combination antenna system 510 with components having different shapes than those in FIG. 4. The combination antenna system 510 includes a first sub 6 GHz antenna portion 520 that might support multiple sub 6 GHz bands and that might be substantially similar to portion A 120 of FIG. 1. The combination antenna system 510 also includes a mmWave antenna array 530 that might be substantially similar to portion B 130 of FIG. 1 or structure 340 of FIG. 3B. The combination antenna system 510 further includes a second sub 6 GHz antenna portion 540 that might be substantially similar to portion C 140 of FIG. 1. The first sub 6 GHz antenna portion 520 is connected to the mmWave antenna array 530 and the mmWave antenna array 530 is connected to the second sub 6 GHz antenna portion 540 by impedance lines 550 that might be substantially similar to the impedance lines 170 and 180 of FIG. 1.

Figure 6:
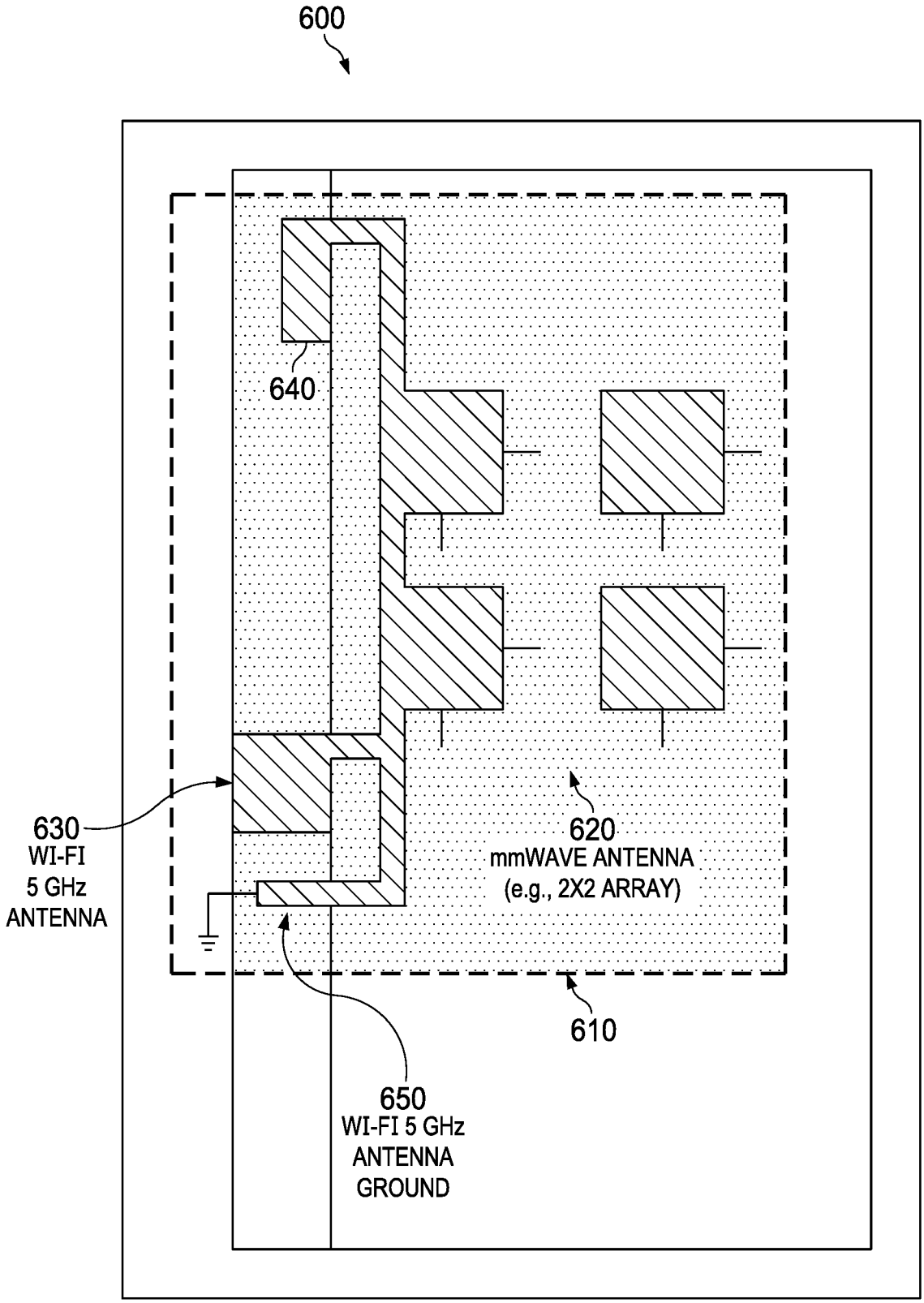
FIG. 6 is a diagram illustrating another embodiment combination sub 6 GHz antenna and mmWave antenna system.

FIG. 6 illustrates a UE 600 that includes an embodiment combination antenna system 610 with components having a different arrangement than those in the previous figures. The combination antenna system 610 includes a mmWave antenna array 620 that might be substantially similar to portion B 130 of FIG. 1 or structure 340 of FIG. 3B. In this example, the mmWave antenna array 620 is a 2×2 array, but only two of the element antennas are used as sub 6 GHz antenna radiators. These two mmWave antennas are coupled to each other through an impedance line, which has impedance proportional to frequency. The combination antenna system 610 also includes a Wi-Fi 5 GHz antenna 630 that might be substantially similar to portion A 120 of FIG. 1. The combination antenna system 610 further includes a sub 6 GHz antenna portion 640 that might be substantially similar to portion C 140 of FIG. 1. The combination antenna system 610 also includes a Wi-Fi 5 GHz antenna ground 650. The mmWave antenna array 620, the Wi-Fi 5 GHz antenna 630, the sub 6 GHz antenna portion 640, and the Wi-Fi 5 GHz antenna ground 650 might work together as an inverted-F type antenna (IFA) at sub 6 GHz frequencies. Although not shown in the figure, the mmWave antenna array 620 might be physically and electrically connected to the Wi-Fi 5 GHz antenna 630 and the sub 6 GHz antenna portion 640 by impedance lines that might be substantially similar to the impedance lines 170 and 180 of FIG. 1 and the impedance line 260 of FIG. 2.

Figure 7:
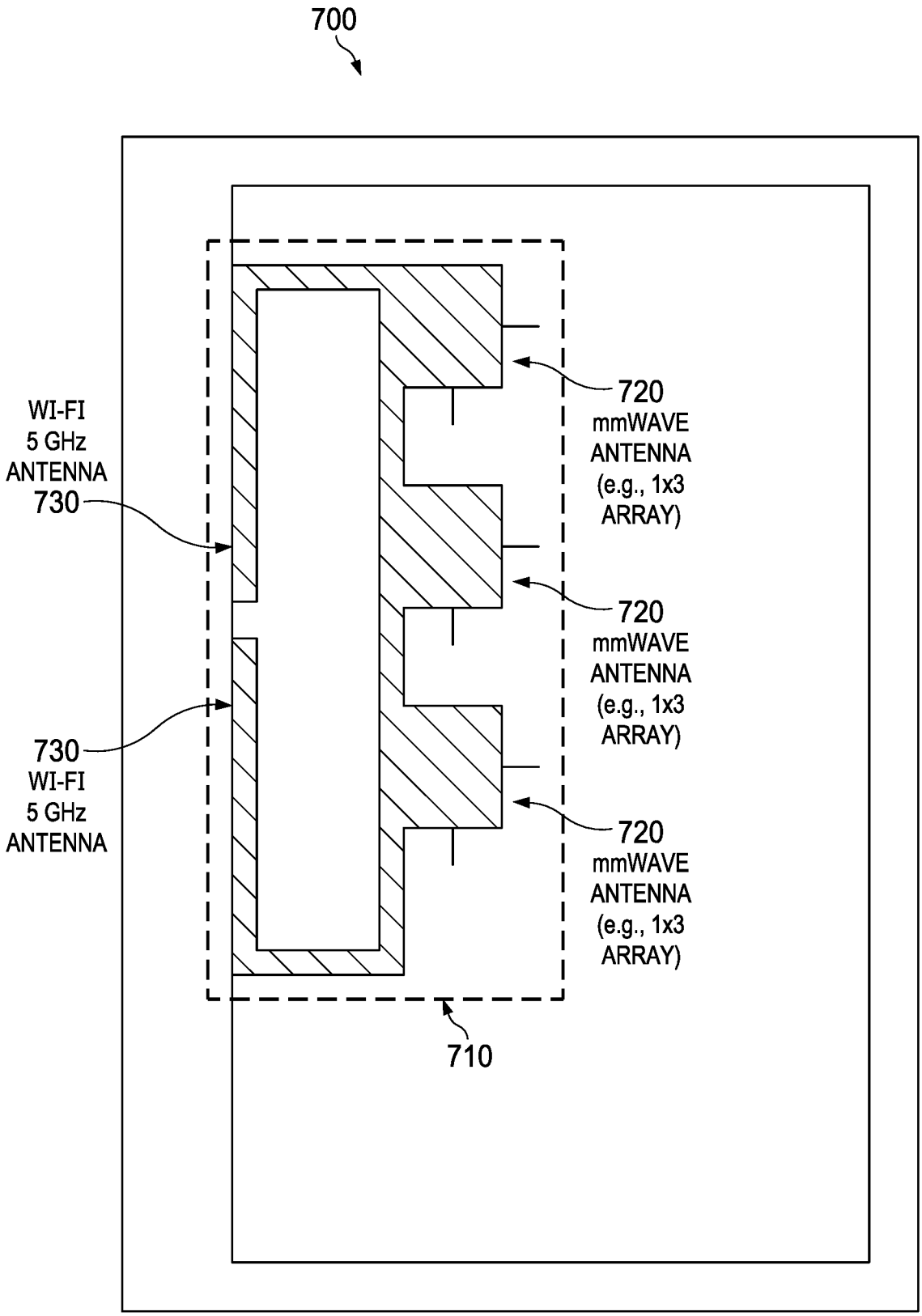
FIG. 7 is a diagram illustrating another embodiment combination sub 6 GHz antenna and mmWave antenna system.

FIG. 7 illustrates a UE 700 that includes an embodiment combination antenna system 710 with mmWave antenna and sub 6 GHz antenna portions having different arrangements than those in FIG. 6. The combination antenna system 710 includes a mmWave antenna array 720 that might be substantially similar to portion B 130 of FIG. 1 or structure 340 of FIG. 3B. In this example, the mmWave antenna array 720 is a 1×3 array. The combination antenna system 710 also includes a Wi-Fi 5 GHz antenna 730 that might be substantially similar to portion A 120 and portion C 140 of FIG. 1. In this example, the Wi-Fi 5 GHz antenna 730 has the form of a loop type antenna. Although not shown in the figure, the mmWave antenna array 720 might be physically and electrically connected to the Wi-Fi 5 GHz antenna 730 by impedance lines that might be substantially similar to the impedance lines 170 and 180 of FIG. 1 and the impedance line 260 of FIG. 2.

Figure 8:
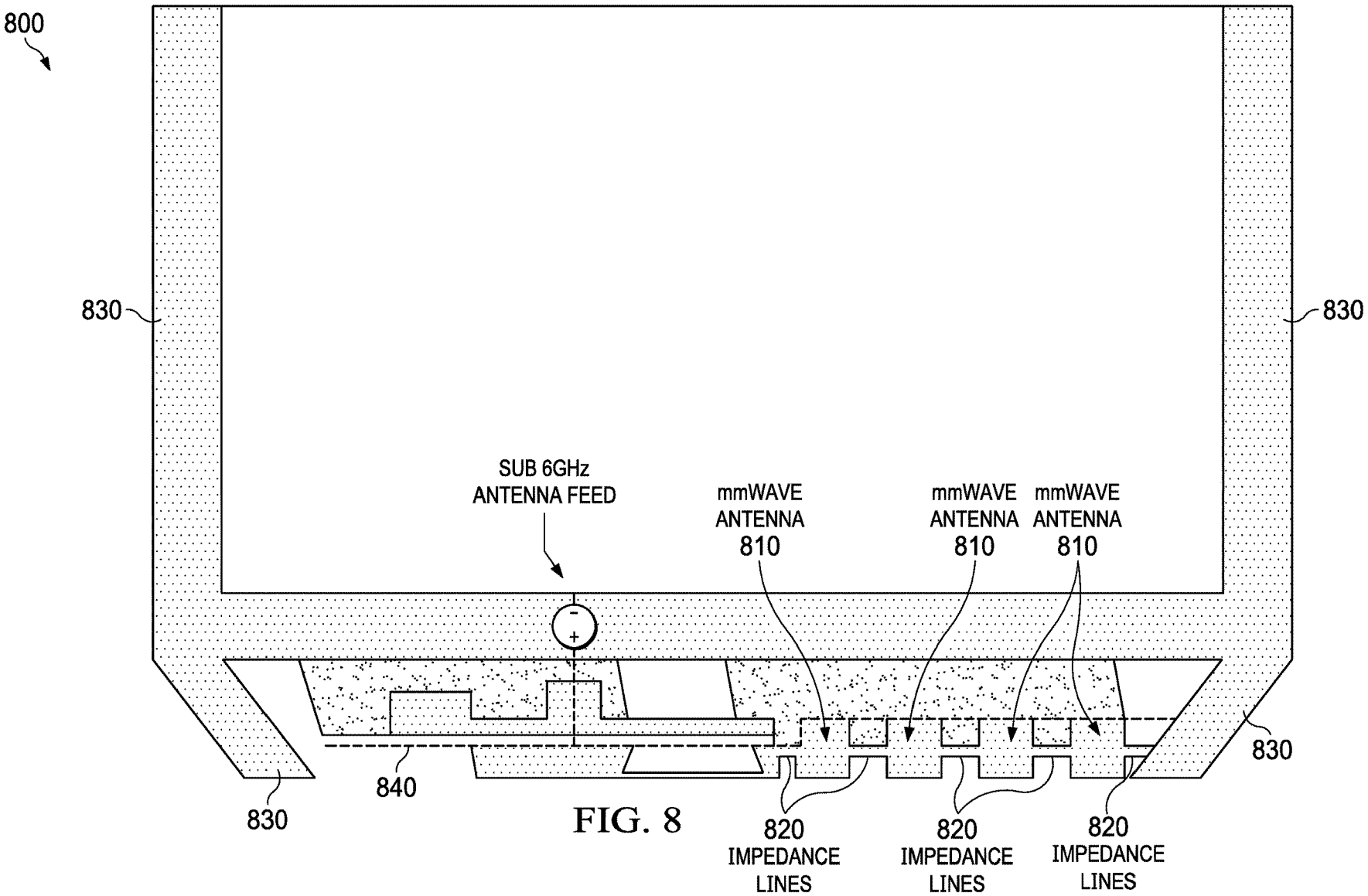
FIG. 8 is a diagram illustrating another embodiment combination sub 6 GHz antenna and mmWave antenna system.

FIG. 8 illustrates a UE 800 that includes another embodiment combination antenna system. In this example, only a mmWave antenna array portion 810 and an impedance line portion 820 of the combination antenna system are shown. The figure is intended to illustrate an example location where the mmWave antenna array 810 and the impedance lines 820 might be located within the UE 800, and thus the mmWave antenna array 810 and the impedance lines 820 are not shown in detail. The mmWave antenna array portion 810 may be a parasitic patch element that is fed capacitively. The mmWave feeding structure may not be part of a sub 6 GHz radiator. The mmWave element patches are connected through impedance lines 820, which have impedance proportional to frequency. A frame 830 surrounds the UE 800, and in this example, the mmWave antenna array 810 and the impedance lines 820 are embedded or otherwise disposed inside the frame 830. A dashed line 840 represents a sub 6 GHz antenna radiator and indicates that the frame 830 is radiating at both sub 6 GHz frequencies and mmWave frequencies. In an embodiment, a sub 6 GHz antenna might be disposed in the UE 800 in such a manner instead of or in addition to the mmWave antenna array 810.

Figure 9:
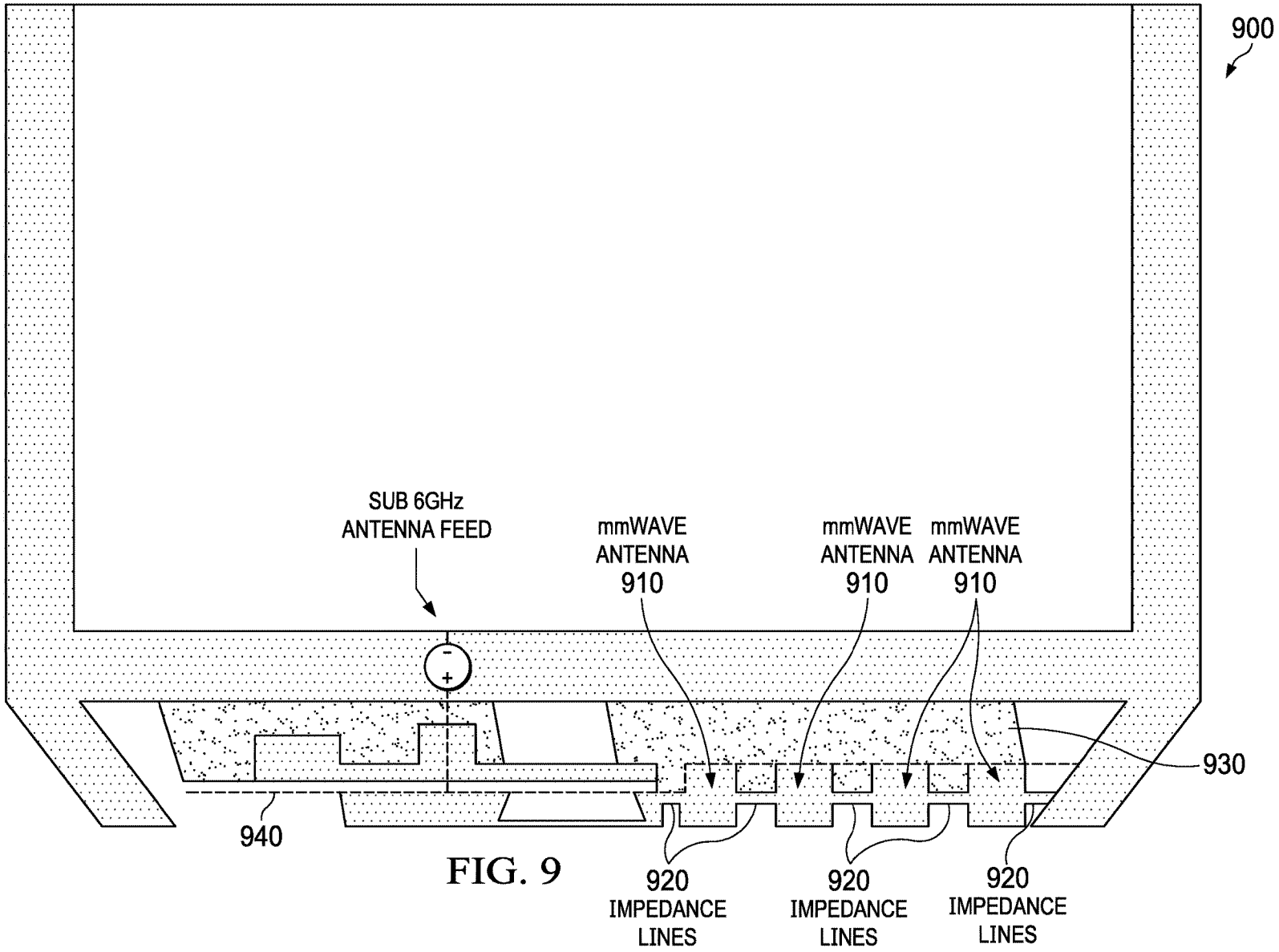
FIG. 9 is a diagram illustrating another embodiment combination sub 6 GHz antenna and mmWave antenna system.

FIG. 9 illustrates a UE 900 that includes another embodiment combination antenna system. In this example, again only a mmWave antenna array portion 910 and an impedance line portion 920 of the combination antenna system are shown. The figure is intended to illustrate another example location where the mmWave antenna array 910 and the impedance lines 920 might be located within the UE 900, and thus the mmWave antenna array 910 and the impedance lines 920 are not shown in detail. In this example, the mmWave antenna array 910 and the impedance lines 920 are printed on a PCB 930 in the UE 900. An electrical connection between the mechanical parts of the UE 900 and the PCB 930 might be realized by using a c-clip. For example, a c-clip might connect to the frame of the UE 900 and its pad might connect to the traces on the PCB 930. A dashed line 940 again represents a sub 6 GHz antenna radiator and indicates that the combination antenna system is radiating at both sub 6 GHz frequencies and mmWave frequencies. In an embodiment, a sub 6 GHz antenna might be disposed in the UE 900 in such a manner instead of or in addition to the mmWave antenna array 910.

Figure 10A:
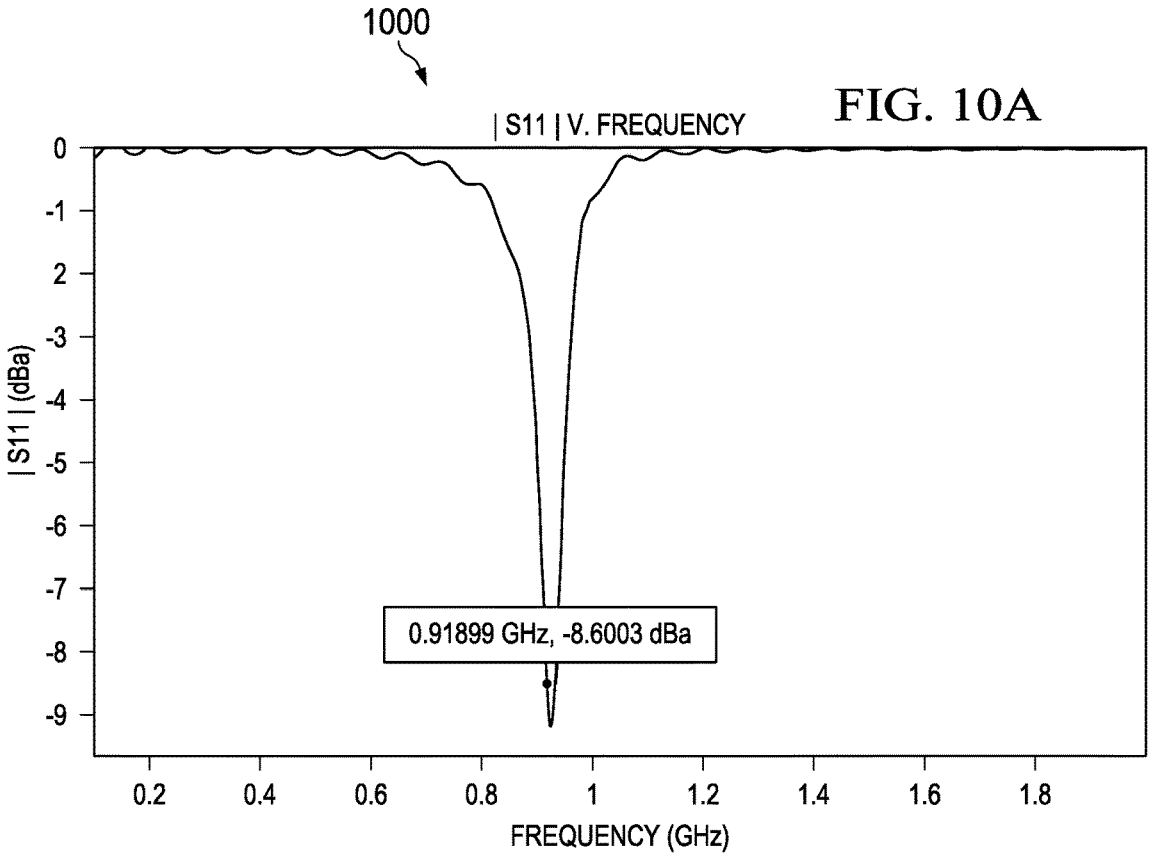
FIG. 10A is a graph illustrating the performance of an embodiment combination sub 6 GHz antenna and mmWave antenna system.
Figure 10B:
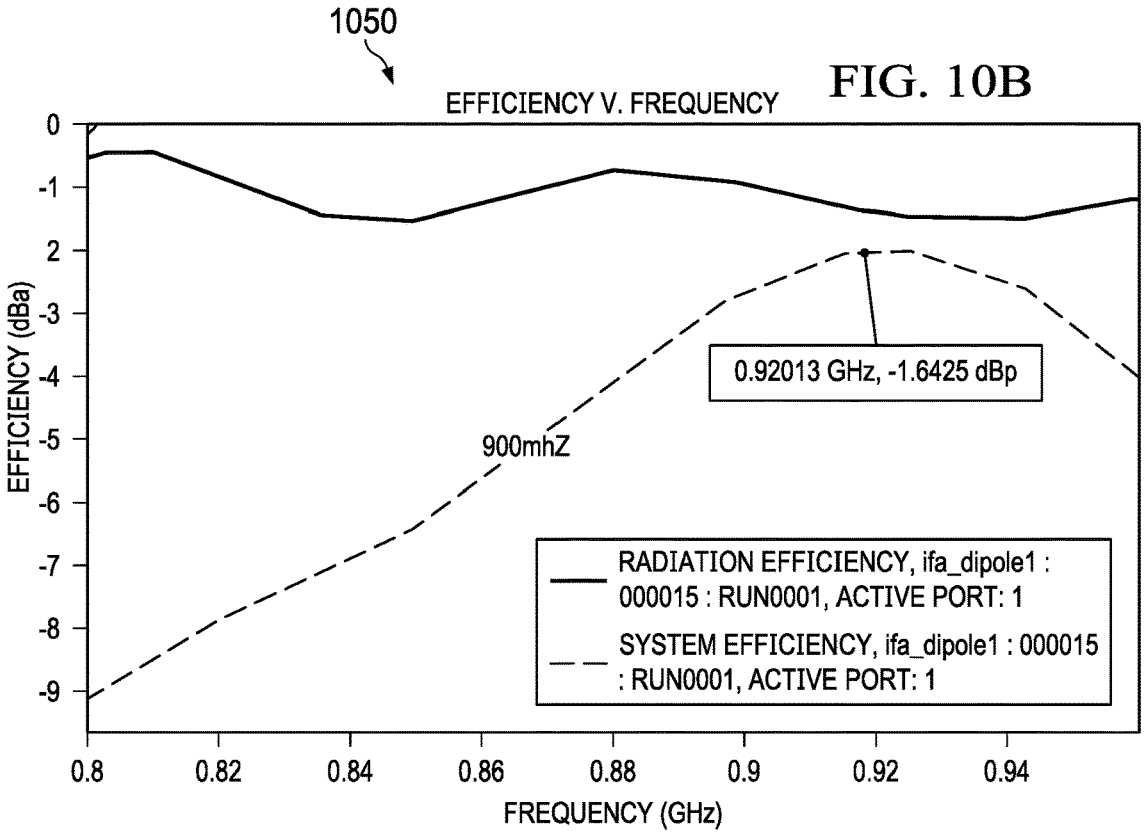
FIG. 10B is another graph illustrating the performance of an embodiment combination sub 6 GHz antenna and mmWave antenna system.

FIG. 10A is a graph 1000 illustrating antenna loss for an embodiment combination antenna system, such as combination antenna system 410 of FIG. 4. FIG. 10B is a graph 1050 illustrating antenna efficiency for an embodiment combination antenna system, such as combination antenna system 410 of FIG. 4.

Figure 11:
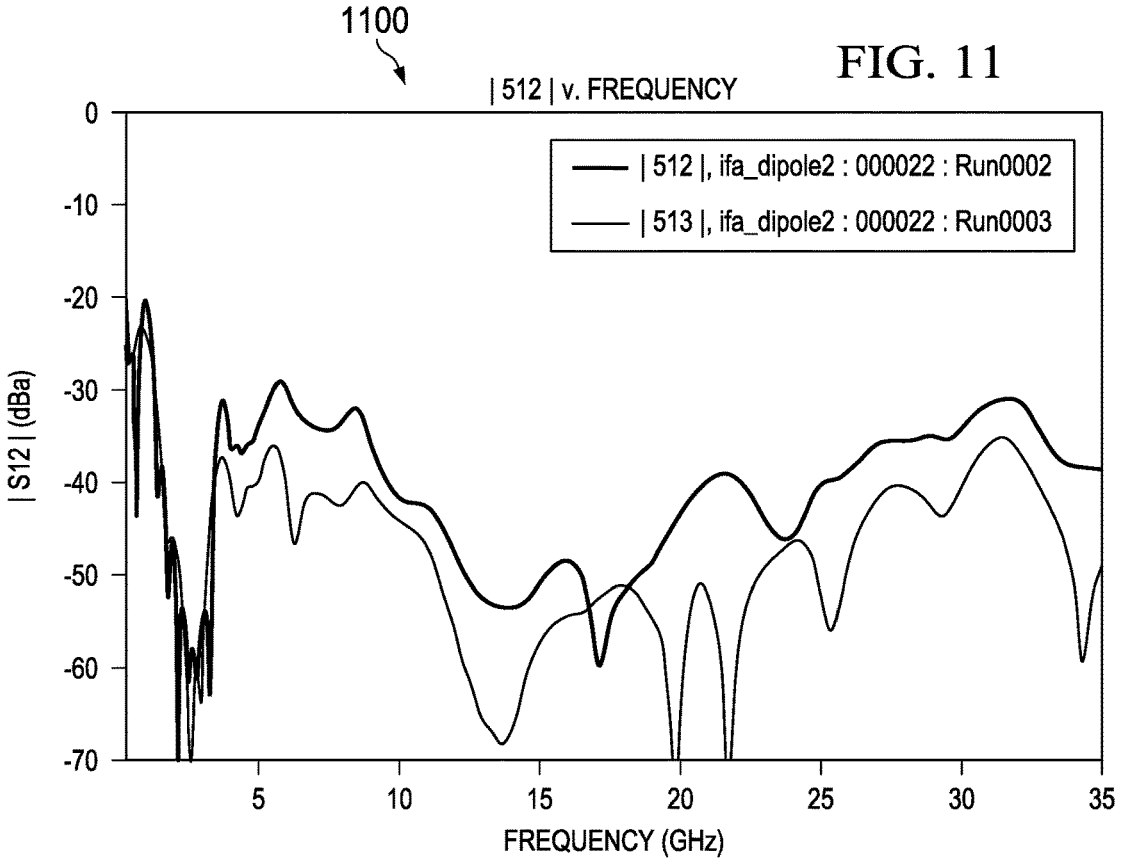
FIG. 11 is a graph illustrating the isolation between ports in an embodiment combination sub 6 GHz antenna and mmWave antenna system.

FIG. 11 is a graph 1100 illustrating the isolation between ports in an embodiment combination antenna system, such as between the first feed 150 and the second feed 160 of FIG. 1. It can be seen that there is little coupling between the ports, and that at sub 6 GHz frequencies, the mmWave port acts like an open circuit.

Figure 12A:
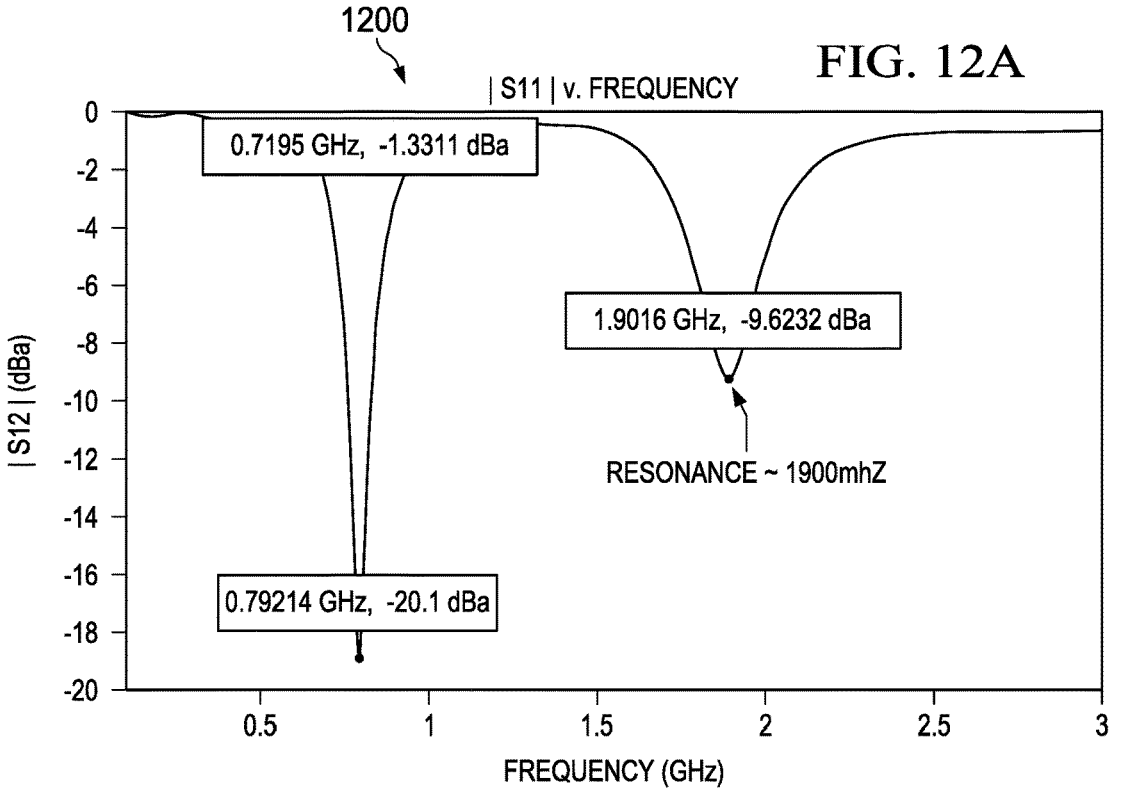
FIG. 12A is a graph illustrating the performance of the sub 6 GHz antenna portion of an embodiment combination sub 6 GHz antenna and mmWave antenna system.
Figure 12B:
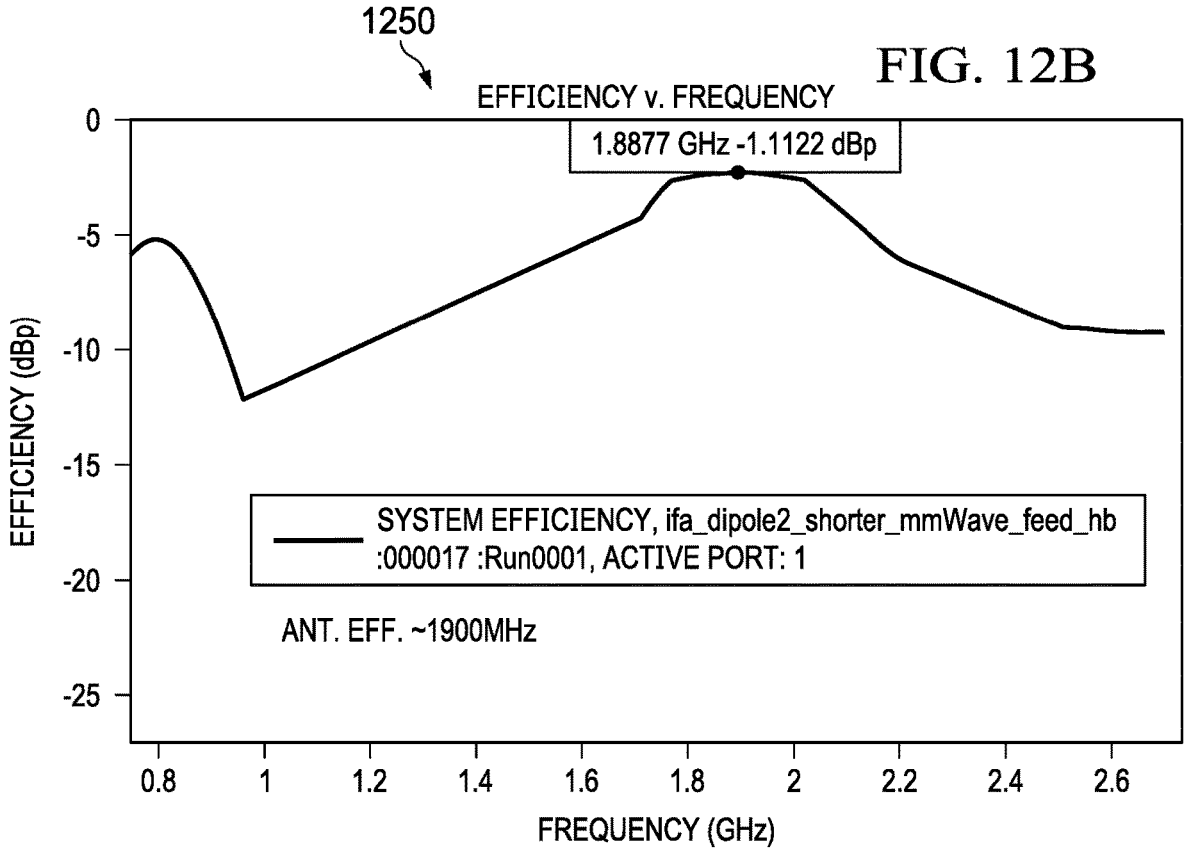
FIG. 12B is another graph illustrating the performance of the sub 6 GHz antenna portion of an embodiment combination sub 6 GHz antenna and mmWave antenna system.

FIG. 12A is a graph 1200 illustrating an aspect of the performance of the sub 6 GHz antenna portion of an embodiment combination antenna system, such as combination antenna system 510 of FIG. 5. FIG. 12B is a graph 1250 illustrating another aspect of the performance of the sub 6 GHz antenna portion of an embodiment combination antenna system, such as combination antenna system 510 of FIG. 5.

It can be seen from the graphs that the presence of both the sub 6 GHz antenna and the mmWave antenna in the same physical antenna structure does not have a significant negative impact on the performance of the two antennas.

Figure 13:
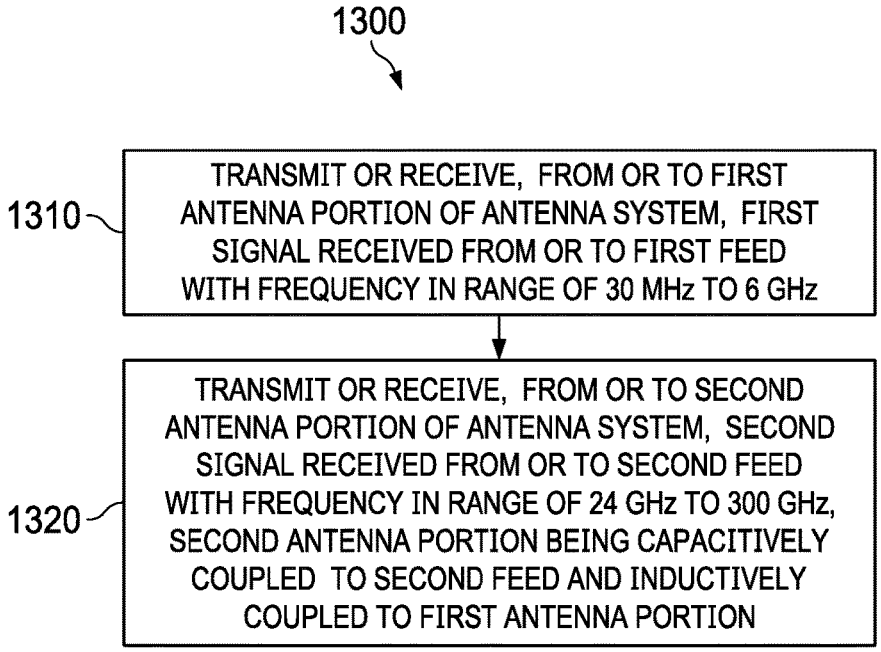
FIG. 13 is a flowchart illustrating a method for transmitting from an antenna system.

FIG. 13 is a flowchart illustrating a method 1300 for transmitting or receiving from an antenna system. At block 1310, a first signal received from or to a first feed is transmitted or received from or to a first antenna portion of the antenna system with a frequency in a range of 30 MHz to 6 GHz. At block 1320, a second signal received from or to a second feed is transmitted or received from or to a second antenna portion of the antenna system with a frequency in a range of 24 GHz to 300 GHz. The second antenna portion is capacitively coupled to the second feed and inductively coupled to the first antenna portion.

While this disclosure has been described with reference to illustrative embodiments, this description is not intended to be construed in a limiting sense. Various modifications and combinations of the illustrative embodiments, as well as other embodiments of the disclosure, will be apparent to persons skilled in the art upon reference to the description. It is therefore intended that the appended claims encompass any such modifications or embodiments.

What is claimed is:

1. An antenna system comprising:

a first antenna portion configured to transmit a first signal received from a first feed; and a second antenna portion configured to transmit a second signal received from a second feed, the second antenna portion capacitively coupled to the second feed and inductively coupled to the first antenna portion, and the second signal having a frequency at least 10 times greater than a frequency of the first signal.

2. The antenna system of claim 1, wherein the second antenna portion is capacitively coupled to the second feed via a capacitive coupling structure that includes a discrete or distributed capacitor.

3. The antenna system of claim 2, wherein the capacitive coupling structure comprises parallel conductive plates in one plane, parallel conductive plates on different planes, or interdigitally coupled lines.

4. The antenna system of claim 1, wherein the second antenna portion is inductively coupled to the first antenna portion via an inductive coupling structure that includes a discrete or distributed inductor.

5. The antenna system of claim 4, wherein the inductive coupling structure comprises a wire-wound discrete inductor or a distributed transmission line on a substrate.

6. The antenna system of claim 1, wherein the first signal has a frequency in a range of 30 megahertz to 6 gigahertz (GHz).

7. The antenna system of claim 1, wherein the second signal has a frequency in a range of 24 GHz to 300 GHz.

8. The antenna system of claim 1, further comprising a third antenna portion inductively coupled to the second antenna portion and configured to transmit the first signal, the first signal having been received by the third antenna portion via the first antenna portion and the second antenna portion.

9. The antenna system of claim 8, wherein the inductive coupling(s) between the second antenna portion and each of the first antenna portion and the third antenna portion creates impedance that attenuates signals at a frequency of the second signal more than signals at a frequency of the first signal.

10. The antenna system of claim 1, wherein the first antenna portion is at least one of:

disposed within a frame of a device that includes the antenna system; or disposed on a rigid or flexible circuit board within a device that includes the antenna system.

11. The antenna system of claim 1, wherein the second antenna portion is at least one of:

disposed within a frame of a device that includes the antenna system; or disposed on a rigid or flexible circuit board within a device that includes the antenna system.

12. An antenna system comprising:

a first antenna portion configured to transmit a first signal received from a first feed;

a second antenna portion configured to transmit a second signal received from a second feed, the second antenna portion capacitively coupled to the second feed and inductively coupled to the first antenna portion, and the second signal having a frequency greater than a frequency of the first signal; and a third antenna portion inductively coupled to the second antenna portion and configured to transmit the first signal, the first signal having been received by the third antenna portion via the first antenna portion and the second antenna portion.

13. The antenna system of claim 12, wherein the second antenna portion is capacitively coupled to the second feed via a capacitive coupling structure that includes a discrete or distributed capacitor.

14. The antenna system of claim 13, wherein the capacitive coupling structure comprises parallel conductive plates in one plane, parallel conductive plates on different planes, or interdigitally coupled lines.

15. The antenna system of claim 12, wherein the second antenna portion is inductively coupled to the first antenna portion via a first inductive coupling structure that includes at least one discrete or distributed inductor, and wherein the second antenna portion is inductively coupled to the third antenna portion via a second inductive coupling structure that includes at least one discrete or distributed inductor.

16. The antenna system of claim 15, wherein at least one of the first inductive coupling structure or the second inductive coupling structure comprises a wire-wound discrete inductor or a distributed transmission line on a substrate.

17. The antenna system of claim 12, wherein the first signal is a sub 6 gigahertz signal.

18. The antenna system of claim 12, wherein the second signal is a millimeter wave signal.

19. The antenna system of claim 12, wherein the frequency of the second signal is at least ten times greater than the frequency of the first signal.

20. The antenna system of claim 12, wherein the inductive coupling(s) between the second antenna portion and each of the first antenna portion and the third antenna portion creates impedance that attenuates signals at a frequency of the second signal more than signals at a frequency of the first signal.

21. The antenna system of claim 12, wherein the first antenna portion is at least one of:

disposed within a frame of a device that includes the antenna system; or disposed on a rigid or flexible circuit board within a device that includes the antenna system.

22. The antenna system of claim 12, wherein the second antenna portion is at least one of:

disposed within a frame of a device that includes the antenna system; or disposed on a rigid or flexible circuit board within a device that includes the antenna system.

23. An antenna system comprising:

a plurality of feeds including at least a first feed and a second feed;

a first antenna portion coupled to the first feed; and a second antenna portion capacitively coupled to the second feed via a capacitive coupling structure, the second antenna portion inductively coupled to the first antenna portion, and the second antenna portion configured to operate over a different frequency range than the first antenna portion, wherein the frequencies of signals of the second feed coupled to the second antenna portion are in a range greater than or equal to 24 GHz and frequencies of signals of the first feed coupled to the first antenna portion are in a range less than or equal to 6 GHz.

24. The antenna system of claim 23, wherein the capacitive coupling structure includes a discrete or distributed capacitor.

25. The antenna system of claim 24, wherein the capacitive coupling structure comprises parallel conductive plates in one plane, parallel conductive plates on different planes, or interdigitally coupled lines.

26. The antenna system of claim 23, wherein the second antenna portion is inductively coupled to the first antenna portion via an inductive coupling structure that includes a discrete or distributed inductor.

27. The antenna system of claim 26, wherein the inductive coupling structure comprises a wire-wound discrete inductor or a distributed transmission line on a substrate.

28. The antenna system of claim 23, wherein the first antenna portion is configured to transmit signals within a frequency range of 30 megahertz to 6 gigahertz (GHz).

29. The antenna system of claim 23, wherein the second antenna portion is configured to transmit signals within a frequency range of 24 GHz to 300 GHz.

30. The antenna system of claim 23, further comprising a third antenna portion inductively coupled to the second antenna portion and configured to operate at a different frequency range than the second antenna, the inductive coupling(s) between the second antenna portion and each of the first antenna portion and the third antenna portion creating impedance that attenuates signals within a frequency range of the second antenna portion more than signals within frequency range(s) of the first antenna portion and the third antenna portion.

31. The antenna system of claim 30, wherein the first antenna portion and the third antenna portion are configured to transmit signals within the same frequency range.

32. The antenna system of claim 30, wherein the first antenna portion and the third antenna portion are configured to transmit signals within overlapping frequency ranges.

* * * * *